United States Patent [19]

Opresko

[11] Patent Number: 4,567,400

[45] Date of Patent: Jan. 28, 1986

[54] CRT COMPRISING METALLIZED GLASS BEADS FOR SUPPRESSING ARCING THEREIN

[75] Inventor: Stephen T. Opresko, Lancaster, Pa.

[73] Assignee: RCA Corporation, Princeton, N.J.

[21] Appl. No.: 470,561

[22] Filed: Feb. 28, 1983

[51] Int. Cl.[4] ..... H01J 29/82

[52] U.S. Cl. ..... 313/457

[58] Field of Search ..... 313/417, 457, 479

[56] References Cited

U.S. PATENT DOCUMENTS

| | | | |
|---|---|---|---|
| 3,558,954 | 1/1971 | Lilley | 313/82 |
| 4,255,689 | 3/1981 | Fischman et al. | 313/479 X |
| 4,288,719 | 9/1981 | Hernqvist | 313/457 |
| 4,338,543 | 7/1982 | Handel | 313/457 |
| 4,353,006 | 10/1982 | Schade | 313/457 |
| 4,366,415 | 12/1982 | Takenaka et al. | 313/417 X |

*Primary Examiner*—Palmer C. DeMeo
*Assistant Examiner*—Sandra L. O'Shea
*Attorney, Agent, or Firm*—E. M. Whitacre; D. H. Irlbeck; L. Greenspan

[57] ABSTRACT

A CRT comprising an evacuated envelope having an electrically-insulating neck and a beaded electron-gun mount assembly in the neck. Portions of the surfaces of the beads facing the inner surface of the neck carry electrically-conducting coatings for suppressing arcing during the operation of the tube. The coatings and the claws of the electrodes embedded in the beads are positioned to minimize erosion of the patches during electrical processing of the electrodes.

7 Claims, 5 Drawing Figures

CRT COMPRISING METALLIZED GLASS BEADS FOR SUPPRESSING ARCING THEREIN

BACKGROUND OF THE INVENTION

This invention relates to a novel CRT (cathode-ray tube) comprising a beaded electron-gun mount assembly in which the glass beads or support rods carry electrically-conductive coatings for suppressing arcing therein; and particularly for suppressing flashovers in the neck of a CRT.

A color television picture tube is a CRT comprising an evacuated glass envelope including a viewing window which carries a luminescent viewing screen thereon, and a glass neck which houses an electron-gun mount assembly for producing one or more electron beams for selectively scanning the viewing screen. In one common design, the electron-gun mount assembly comprises, for each beam to be produced, a cathode and a plurality of electrodes supported as a unit in spaced tandem relation from at least two elongated, axially-oriented support rods, which are usually in the form of glass beads.

The end electrode (to which is applied the anode voltage) and the adjacent focus electrode (to which is applied a focusing voltage) define a gap of predetermined width. When the CRT is operating, the difference in the voltages that are applied to these electrodes produces a focus electric field across the gap. In some embodiments, the focusing electrode comprises two tub-shaped cups of about equal size that are joined together at their open ends through integral peripheral flanges. The flanges may include also outwardly-extending claws which are embedded in the glass beads mentioned above.

The glass beads have extended surfaces that are closely spaced from and face the inner surface of the neck. The spaces between the beads and the neck, which extend from a low field region close to the cathode to the region close to the end electrode where the ambient electric fields are highest, are channels in which leakage currents may travel. These leakage currents are associated with blue glow in the neck glass, with charging of the neck surface and with arcing and flashover in the neck.

Several expedients have been suggested for blocking or reducing these leakage currents. One expedient which has been found to be particularly effective is disclosed in U.S. Pat. No. 4,288,719 to K. G. Hernqvist issued Sept. 8, 1981. That Hernqvist patent discloses a CRT including a beaded electron-gun mount assembly in which each glass bead has an electrically-conductive metal coating on the bead surface facing the neck. It has been found, however, that when the electrodes of the electron gun are electrically processed; e.g., by spot knocking, the electrically-conductive coatings are eroded, producing undesirable particles in the CRT. Both the claws and the flanges comprising the focus electrode are opposite the coatings on the beads of the electron-gun mount assemblies disclosed in the Hernqvist patent.

SUMMARY OF THE INVENTION

The novel CRT including the electron-gun mount assembly therein is similar in construction to the prior CRT disclosed in the Hernqvist patent, except that the claws of the focus electrode and the electrically-conductive coatings on the glass beads are repositioned with respect to one another so that: the coatings are located at least four times the gap width away from positions on the bead surfaces opposite the gap between the end electrode and the focus electrode, and either: (i) the claws of the focus electrode are opposite uncoated portions of the beads, or (ii) the claws of the focus electrode are more than half the distance between the ends of the focus electrode away from said gap.

By repositioning the claws of the focus electrode and the metal coatings on the beads with respect to one another and with respect to the gap, erosion of the coatings during electrical processing of the electrodes is minimized so that substantially no particles are generated. Also, the extinction voltage of the gun is raised by several kilovolts so that the CRT is less likely to exhibit afterglow following its operation.

DETAILED DESCRIPTION OF THE PREFERRED EMBODIMENT

Figure 1:
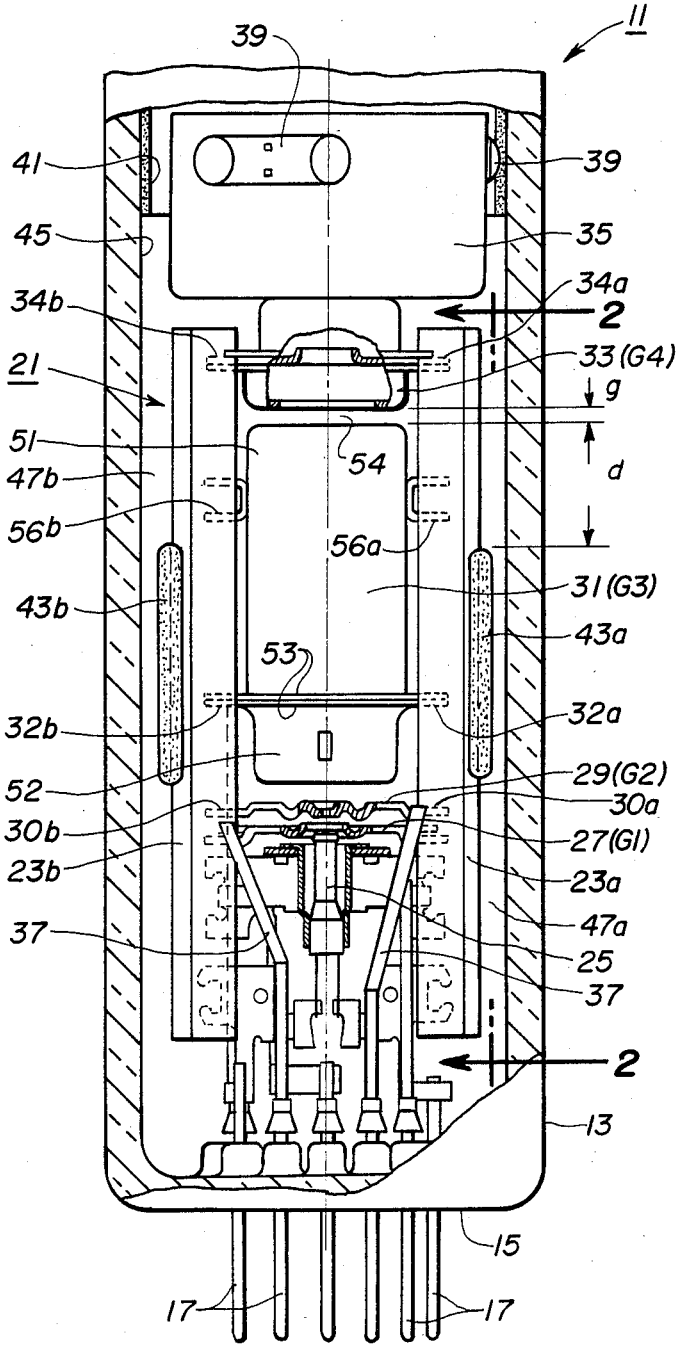
FIG. 1 is a broken-away elevational view of the neck of a first embodiment of the novel CRT.
Figure 2:
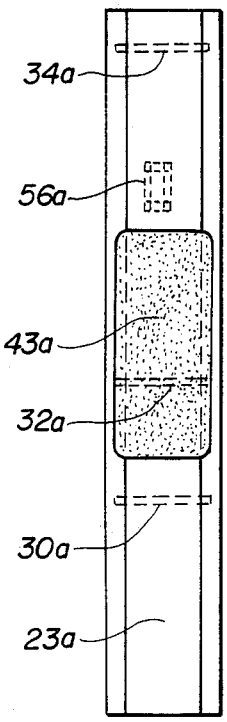
FIG. 2 is an elevational view along section line 2—2 of a glass bead of the CRT shown in FIG. 1.

FIGS. 1 and 2 show structural details of the neck of a particular shadow-mask-type color television picture tube. The structure of this CRT, which is a rectangular 25 V-size tube with a 110° deflection, is conventional except for the electron-gun mount assembly. The structural details thereof are similar to those described in U.S. Pat. No. 4,288,719 issued Sept. 8, 1981 to K. G. Hernqvist. The CRT includes an evacuated glass envelope 11 comprising a rectangular faceplate panel (not shown) sealed to a funnel having a neck 13 integrally attached thereto. A glass stem 15 having a plurality of leads or pins 17 therethrough is sealed to and closes the neck 13 at the end thereof. A base may be attached to the pins 17 outside the envelope 11. The panel includes a viewing window which carries on its inner surface a luminescent viewing screen comprising phosphor lines extending in the direction of the minor axis thereof, which is the vertical direction under normal viewing conditions.

An in-line beaded bipotential electron-gun mount assembly 21, centrally mounted within the neck 13, is designed to generate and project three electron beams along coplanar convergent paths to the viewing screen. The mount assembly 21 comprises two support rods in the form of glass beads **23*a* and 23*b* from which the various electrodes are supported to form a coherent unit in a manner commonly used in the art. These electrodes include three substantially equally transversely spaced coplanar cathodes 25 (one for producing each beam), a control-grid electrode (also referred to as G1) 27, a screen-grid electrode (also referred to as G2) 29, an accelerating-and-focus electrode (also referred to as G3) 31, an end electrode (also referred to as G4) 33, and a shield cup 35 longitudinally spaced in that order by the beads 23*a* and 23*b*. The electrodes are held in predetermined positions by means of claws which are integral with the electrodes and which are embedded in the beads. The G3 claws 32a and 32b for the G3 are of particular interest in this embodiment. The various electrodes of the mount assembly 21 are electrically connected to the pins 17 either directly or through metal ribbons 37. The mount assembly 21 is held in a predetermined position in the neck 13 on the pins 17 and with snubbers 39 which press on and make contact with the electrically-conducting internal coating 41 on the inside surface 45 of the neck 13. The internal coating 41** extends over the inside surface of the funnel and connects to the anode button (not shown).

Each of the beads 23a and 23b is about 10 mm (millimeters) wide by about 50 mm long and carries an electrically-conductive coating or patch 43a and 43b respectively on the portion of its surface facing and spaced from the inside surface of the neck 13. Each bead is metallized; that is, it receives its conductive coating or patch 43a and 43b before the bead is incorporated into the mount assembly. In this embodiment, each bead was coated in the desired area with Hanovia Liquid Bright Platinum No. 5, which is a metal resinate marketed by Englehard Industries, Inc., East Newark, N.J. A resinate coating may be produced by any of the known processes, such as painting, screening, spraying, or by print transfer. The resinate-coated bead is then heated to about 500° C. in air to volatilize organic matter and to cure the coating and then is cooled to room temperature. In this embodiment, the product is a coating comprised of an alloy of platinum and gold that is tightly bonded to the surface of the bead. The metallized beads may then be used in any of the known beading processes for assembling a beaded mount assembly. Each coating or patch 43a and 43b, as shown in FIG. 2, is substantially rectangular with rounded corners and is about 15 mm long by about 9 mm wide, which is almost the full width of the bead. Each coating or patch is about 1,000 Angstroms thick except at the edges where it is tapered to a thickness of about 500 Angstroms. Each area is floating electrically and has a resistivity of about 50 ohms per square as measured with silver paste contacts applied along the upper and lower edges of the patch and spaced about 12 mm apart.

The tube may be operated in its normal way by applying operating voltages to the pins 17 and to the internal coating 41 through the anode button; which, for example, are typically less than 100 volts on G1, about 600 volts on G2, about 8,000 volts on G3 and about 30,000 volts on G4. Because of the beaded structure described, the regions between the beads and the neck, which can be called the bead channels 47, behave differently from the regions between the neck and the other parts of the mount assembly, which can be called the gun channels. Arcing (flashover), when it occurs, occurs in the bead channels 47a and 47b when the tube is operating and the patches 43a and 43b are absent. However, when the patches are present as shown in FIGS. 1 and 2, arcing in these channels is almost completely suppressed.

The G3 or focus electrode comprises a larger tub-shaped cup 51 towards the G4 and a smaller tub-shaped cup 52 towards the G2, which cups are joined together at their open ends by means of integral peripheral flanges 53. The claws 32a and 32b are integral with the flanges 53. The closed end of the upper cup 51 is spaced from the G4 by a G3–G4 gap 54 having a gap width g of about 1.25±0.20 mm (50±8 mils).

The first embodiment shown in FIG. 1 is distinguished from the embodiment in the Hernqvist patent, op.cit., in that the nearest edges of the patches 43a and 43b are a distance d that is more than four times the gap width g away from the G3–G4 gap 54. In the first embodiment, the distance d is about 6.4 mm (250 mils). Furthermore, the claws 32a and 32b and the flanges 53 are each more than half the length of the G3 away from the G3–G4 gap. The U-shaped braces 56a and 56b have substantially no effect on arcing or electrode treatment in this embodiment.

By relocating the patches 43a and 43b, the claws 32a and 32b and the flanges 53 with respect to the G3–G4 gap and with respect to one another, substantially no particles are produced during the usual electrical processing of the electrodes, due to erosion of the patches 43a and 43b. Any electrical processing, such as spot knocking with or without radio-frequency pulses applied, may be used; for example, the processes disclosed in U.S. Pat. Nos. 3,966,287 to P. R. Liller, 4,125,306 to J. T. Coble and 4,214,798 to L. F. Hopen.

Another benefit from the relocations mentioned above is that the extinction voltage for the electron-gun mount assembly is raised by about 4 kilovolts (from about 24 kv to about 28 kv in the first embodiment). Extinction voltage is the highest voltage applied to the G4 (with G3 grounded) at which the G3 does not emit electrons. Thus, with the CRT installed in a television receiver, when the receiver is turned off after operating, the novel CRT is less likely to exhibit afterglow as a result of such electron emission.

Figure 3:
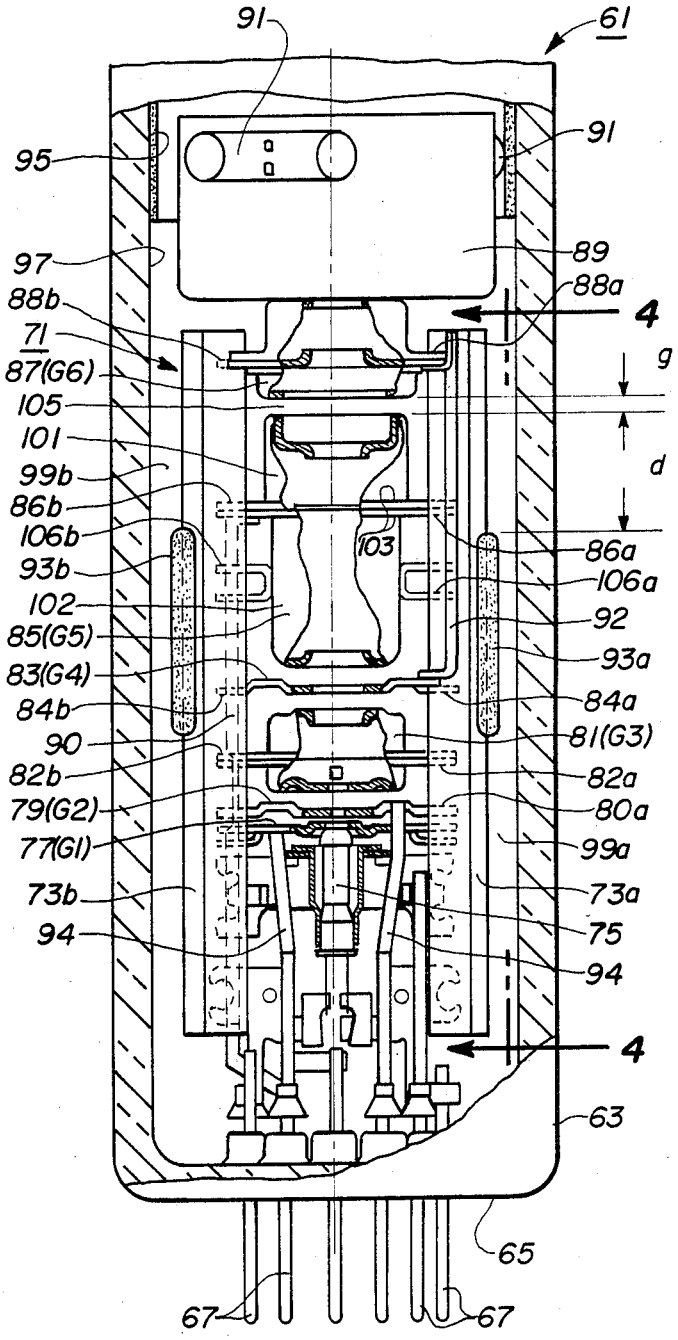
FIG. 3 is a broken-away elevational view of the neck of a second embodiment of the novel CRT.
Figure 4:
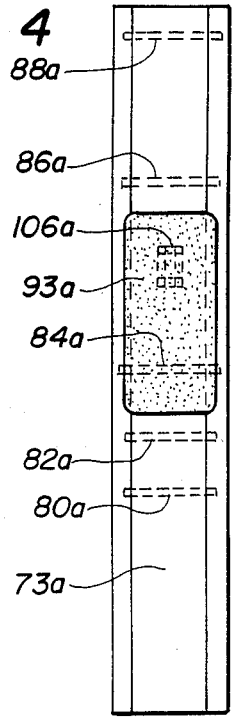
FIG. 4 is an elevational view along section line 4—4 of a glass bead of the CRT shown in FIG. 3.

FIGS. 3 and 4 show a second embodiment comprising six electrodes instead of four electrodes as in the first embodiment. The construction and advantages of the second embodiment are the same or similar to those of the first embodiment except as will be developed below. The second embodiment includes an evacuated glass envelope 61 comprising a rectangular faceplate panel (not shown) sealed to a funnel having a neck 63 integrally attached thereto. A glass stem 65 having a plurality of leads or pins 67 therethrough is sealed to and closes the neck 63 at the end thereof. A base may be attached to the pins 67 outside the envelope 61. The panel (not shown) includes a viewing window which carries on its inner surface a luminescent viewing screen comprising phosphor lines extending in the direction of the minor axis thereof.

An in-line, beaded, bipotential electron-gun mount assembly 71 centrally mounted within the neck 63 is designed to generate and project three electron beams along coplanar convergent paths to the viewing screen. The mount assembly comprises two glass support rods or beads 73a and 73b from which the various electrodes are supported in predetermined positions to from a coherent unit in a manner commonly used in the art. These electrodes include three substantially equally transversely spaced coplanar cathodes 75 (one for producing each beam), a control-grid electrode (also referred to as G1) 77, a screen-grid electrode (also referred to as G2) 79, a first accelerating-and-focus electrode (also referred to as G3) 81, a second accelerating-and-focus electrode (also referred to as G4) 83, a third accelerating-and-focus electrode (also referred to as G5) 85, an end electrode (also referred to as G6) 87, and a shield cup 89 longitudinally spaced in that order by the beads 73a and 73b by means of claws which are embedded in the beads. The G3 claws 82a and 82b, the G4 claws 84a and 84b and the G5 claws 86a and 86b are of special interest in this embodiment. The G3 and G5 are electrically connected together by the rod 90. The G4 and G6 are electrically connected together by the rod 92. The various electrodes of the mount assembly 71 are electrically connected to the pins 67 either directly or through other metal ribbons 94. The mount assembly is held in a predtermined position in the neck 63 on the pins 67 and with the snubbers 91 which press on and make contact with an electrically-conducting internal coating 95 on the inside surface 97 of the neck 63. The internal coating 95 extends over the inside surface of the funnel and connects to the anode button (not shown).

Each of the beads 73*a* and 73*b* is about 10 mm wide by about 50 mm long and carries an electrically-conductive coating or patch 93*a* and 93*b* respectively on a portion of its surface facing and spaced from the inside surface 97 of the neck 63. The patches are similar in size and composition as was described above with respect to the first embodiment, as shown in FIG. 4. The G5 or third focusing electrode 85 comprises a smaller tub-shaped cup 101 towards the G6 and and a larger tub-shaped cup 102 towards the G4, which cups are joined together at their open ends by means of integral peripheral G5 flanges 103, which have G5 claws 86*a* and 86*b* integral with the G5 flanges 103. The closed end of the upper cup 101 is spaced from the G6 by a G5–G6 gap 105 having a gap width g of about 1.25±0.20 mm (50±8 mils). The nearest edges of the patches 93*a* and 93*b* are a distance d that is more than four times the gap width g away from positions on the bead surface that are opposite the G5–G6 gap 105. In this embodiment, the distance d is about 6.4 mm (250 mils). The G5 claws 86*a* and 86*b* and the flanges 103 are each less than half the length of the G5 away from the G5–G6 gap (unlike the first embodiment) and are opposite positions on the beads 73*a* and 73*b* that are not opposite the patches. The U-shaped braces 106*a* and 106*b* have substantially no effect on arcing or electrode treatment in this embodiment.

By relocating the patches 93*a* and 93*b*, the G5 claws 86*a* and 86*b* and the G5 flanges 103 as compared with the prior structure disclosed in the Hernqvist patent, op. cit., substantially no particles are produced due to the erosion of the patches by any of the possible electrode treatments, as mentioned above. Another unexpected benefit of the relocations is that the extinction voltage for the electron-gun mount assembly is raised by about 4 kilovolts as in the first embodiment.

The tube 61 may be operated in its normal way by applying operating voltage to the pins 67 and to the internal coating 95 through the anode button; which for example, are typically less than 100 volts on G1, about 600 volts on G2, about 8,000 volts on G3 and G5 and about 30,000 volts on G4 and G6. Because of the beaded structure described, the regions between the beads and the neck, which can be called the bead channels 99, behave differently from the regions between the neck and the other parts of the mount assembly. Arcing (flashover), when it occurs, occurs in the bead channels 99*a* and 99*b* when the tube is operating and the conducting areas 93*a* and 93*b* are absent. However, with the conducting areas or patches present as shown in FIG. 3, arcing in these channels is substantially entirely suppressed.

Figure 5:
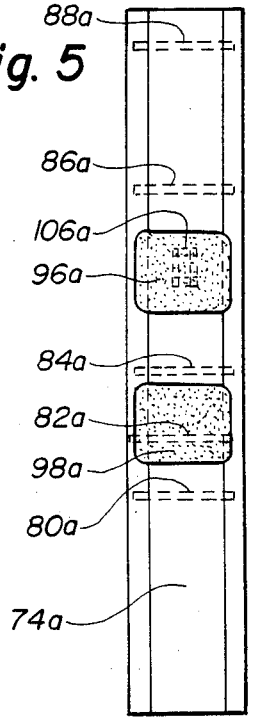
FIG. 5 is an elevational view of a glass bead that may substitute for the glass bead in FIGS. 3 and 4.

With some designs, the patches 93*a* and 93*b* of the second embodiment may be eroded during some electrode treatments. This erosion has been traced to the presence of G4 claw 84*a* of the G4 electrode, which carries the same voltage as the G6 electrode, opposite the patch 93*a*. Erosion of the patch can be minimized by employing the patch structure shown in FIG. 5 in place of the structure shown in FIG. 4. In FIG. 5, two smaller patches 96*a* and 98*a* are located on a bead 74*a* in spaced positions. The one patch 96*a* toward the G6 is located between positions opposite the G5 claw 86*a* of the G5 and the G4 claw 84*a* of the G4, and the other patch 98*a* away from the G6 is located over positions opposite the G3 claw 82*a* and between positions opposite the G2 claw 80*a* and the G4 claw 84*a*.

I claim:

1. In a cathode-ray tube comprising a glass neck and an electron-gun mount assembly in said neck, said mount assembly comprising an electron beam source and a plurality of successively spaced-apart electrodes including an end electrode, means for applying an anode voltage to said end electrode, an adjacent focus electrode, means for applying a focus voltage to said focus electrode, said end electrode and said focus electrode defining a gap of predetermined width, at least two glass beads peripheral to said electrodes for supporting said electrodes at predetermined spacings, said focus electrode comprising outwardly-extending claws embedded in said beads, and an electrically-conductive coating on the outwardly-facing surface of each of said beads, the improvement wherein said coatings are located opposite said focus electrode and are at least four times said gap width away from positions on said outwardly-facing surfaces that are opposite said gap between said end electrode and said focus electrode, and said claws of the focus electrode are not opposite coated portions of said beads that are located up to half the distance between the ends of said focus electrode away from said gap.

2. The cathode-ray tube defined in claim 1 wherein said claws (i) are opposite said coatings on said beads and (ii) are more than half said distance between the ends of said focus electrode away from said gap.

3. The cathode-ray tube defined in claim 1 wherein said claws are (i) opposite uncoated portions of said beads between said coatings and said gap and (ii) are less than half said distance between the end of said focus electrode away from said gap.

4. In a cathode-ray tube comprising

A. an evacuated envelope including an electrically-insulating glass neck and

B. an electron-gun mount assembly in said neck, said mount assembly comprising (i) at least one cathode, (ii) a plurality of electrodes spaced successively from said cathode and from one another and including an end electrode, means for applying an anode voltage to said end electrode, a focus electrode adjacent to said end electrode, means for applying a focus voltage to said focus electrode, each of said electrodes having at least two integral mounting claws, said end electrode and said focus electrode defining a gap of predetermined width, (iii) at least two elongated glass support beads peripheral to said electrodes with said claws embedded therein providing support and affixed positioning for said electrodes, each of said beads having an extended outwardly-facing surface closely spaced from and facing the inner surface of said neck, and (iv) an electrically-conductive coating on a portion of each of said extended bead surfaces opposite said focus electrode, the improvement wherein (a) no portion of said electrically-conductive coatings is opposite a claw on said focus electrode or opposite said gap between said end electrode and said focus electrode and (b) the minimum distance between the edges of said coatings and positions on said bead surfaces opposite said gap is at least four times the width of said gap.

5. The cathode-ray tube defined in claim 4 wherein said mount assembly includes three focus electrodes.

6. In a cathode-ray tube comprising

A. an evacuated envelope including an electrically-insulating glass neck and

B. an electron-gun mount assembly in said neck, said mount assembly comprising (i) at least one cathode, (ii) a plurality of electrodes spaced successively from said cathode and from one another and including an end electrode, means for applying an anode voltage to said end electrode, a focus electrode adjacent said end electrode, means for applying a focus voltage to said focus electrode, each of said electrodes having at least two integral mounting claws, said end electrode and said focusing electrode defining a gap of predetermined width, (iii) at least two elongated glass support beads peripheral to said electrodes with said claws embedded therein providing support and affixed positioning for said electrodes, each of said beads having an extended outwardly-facing surface closely spaced from and facing the inner surface of said neck, and (iv) an electrically-conductive coating on a portion of each of said extended bead surfaces opposite said focus electrode, the improvement wherein (a) said claws on said focus electrode are more than half the distance between the ends of said focus electrode away from said gap and (b) the minimum distance between the edges of each of said coatings closest to said end electrode and positions on said extended bead surfaces opposite said gap is at least four times the width of said gap.

7. The cathode-ray tube defined in claim 6 wherein said mount assembly includes one focus electrode.

* * * * *